United States Patent [19]

Miller

[11] 4,411,606

[45] Oct. 25, 1983

[54] GEROTOR GEAR SET DEVICE WITH INTEGRAL ROTOR AND COMMUTATOR

[75] Inventor: Laurence L. Miller, West Lafayette, Ind.

[73] Assignee: TRW, Inc., Cleveland, Ohio

[21] Appl. No.: 216,368

[22] Filed: Dec. 15, 1980

[51] Int. Cl.[3] ..... F01C 1/02

[52] U.S. Cl. ..... 418/61 B

[58] Field of Search ..... 418/61 B

[56] References Cited

U.S. PATENT DOCUMENTS

| | | | |
|---|---|---|---|
| 3,289,542 | 12/1966 | Fikse | 418/61 B |
| 3,796,525 | 3/1974 | Kilmer | 418/61 B |
| 4,087,215 | 5/1978 | Miller | 418/61 B |
| 4,139,335 | 2/1979 | Wusthof et al. | 418/61 B |
| 4,219,313 | 8/1980 | Miller et al. | 418/61 B |
| 4,264,288 | 4/1981 | Wusthof et al. | 418/61 B |

*Primary Examiner*—Charles J. Myhre
*Assistant Examiner*—Magdalen Moy
*Attorney, Agent, or Firm*—Yount & Tarolli

[57] ABSTRACT

A hydraulic device with fluid pockets formed by a gerotor gear set, including a rotatable and orbital rotor, has a special commutation valve structure for valving fluid flow to and from the fluid pockets in timed relation to the movement of the rotor. The gear set is disposed between a pair of housing members. One end face of the rotor and the face of the adjacent housing member cooperate to define separate pressure areas which are continuously communicated with high and low fluid pressures, respectively. The other end face of the rotor has a circular array of openings which number twice the number of teeth of the rotor. A series of passages extending through the rotor communicate all of the openings of the circular array with the separate pressure areas, alternate openings being communicated with areas at different pressures. The face of the housing member adjacent the other end face of the rotor has radially extending, generally T-shaped recesses facing the fluid pockets. The circular array of openings in the rotor and the recesses in the housing member cooperate to valve flow and direct flow to and from the pockets at the interface of the rotor and housing member as the rotor rotates and orbits.

14 Claims, 13 Drawing Figures

GEROTOR GEAR SET DEVICE WITH INTEGRAL ROTOR AND COMMUTATOR

BACKGROUND OF THE INVENTION

This invention relates to a hydraulic device having fluid pockets formed by a gerotor gear set. It relates particularly to a commutation system for directing flow to and from the fluid pockets.

Hydraulic devices with fluid pockets formed by gerotor gear sets are known. Typically, gerotor gear sets include a stator having internal teeth and a rotor having external teeth. The number of teeth on the rotor is one less than the number of teeth on the stator. The rotor is eccentrically disposed within the stator and rotates and orbits relative to the stator. The rotor is supported and guided in its rotating and orbiting motion by the teeth of the stator. The teeth of the rotor and stator define the fluid pockets, which expand and contract during the rotary and orbital movement of the rotor.

Various valve constructions have been developed for directing fluid into and out of the expanding and contracting fluid pockets. In one known type of valve construction, shown in U.S. Pat. No. RE. 25,291, a rotatable valve member is spaced from the gear set and connected with the rotor so as to be rotated at the speed of rotation of the rotor. In another known type of valve construction, shown in U.S. Pat. No. 3,288,034, a rotatable valve member is spaced from the gear set and connected with the rotor so as to be rotated at the speed of orbital movement of the rotor. The foregoing valve constructions involve separate valve members and drive connections between the valve members and the gerotor gearset.

Some known types of valve constructions eliminate the use of separate valve elements spaced from the gear set and/or the drive connection between the gear set and the valve elements. For example, in U.S. Pat. No. 3,598,509, a valve plate is coupled to the rotor to rotate and orbit therewith. The valve plate has a circular array of openings with alternate openings connected to high and low pressure, respectively. The valve plate is adjacent one side of the gear set, and the circular array of openings cooperates with the teeth of the stator to valve flow into and out of the expanding and contracting fluid pockets.

In U.S. Pat. No. 211,769, the rotor itself forms the valve for controlling flow into and out of the fluid pockets. The rotor cooperates with a series of dog-leg shaped passages formed in housing members on each side of the rotor. Those passages have radially inward ends disposed along a circle and radially outward ends communicating with the pockets. Each face of the rotor has a pair of concentric pressure areas communicated with the high and low pressures. As the rotor rotates and orbits, the movement of the concentric pressure areas relative to the inward ends of the dog-leg shaped passages valves flow. The arrangement is such that flow is directed into the pockets from one side of the gear set and out of the pockets from the other side of the gear set.

A device with valve structure similar to U.S. Pat. No. 211,769 is shown in German Offenlegungsschrift (OS) No. 2,921,311. In OS No. 2,921,311 one side of the rotor has concentric pressure areas communicated with the high and low pressures and an adjacent valve plate has dog-leg shaped passages therein. Flow is valved at the interface of the rotor and the valve plate, and directed to and from the pockets through the dog-leg shaped passages in the valve plate.

Yet another type of valve structure involving the rotor is disclosed in U.S. Pat. No. 3,825,376. In the device shown in U.S. Pat. No. 3,825,376, high and low pressures are communicated with respective ones of pairs of openings in a manifold plate adjacent to the gear set. The rotor includes a series of triangular shaped openings which widen toward the outer periphery of the rotor and which number one less than the teeth of the rotor. The triangular openings are designed so that in certain positions of the rotor they establish a short circuit between adjacent pockets. The patent describes various positions of the rotor during one orbit, and the described positions show a variation in the number of fluid pockets which are in communication with one port or the other. For example, the patent describes a position in which two pockets are communicated to opposite ports, whereas the three remaining pockets are blocked from the ports. It describes another position in which one pocket is connected to the high pressure port, two pockets are connected to the low pressure port, and the remaining two pockets are interconnected by one of the triangular openings in the rotor. The displacement of such a device for a given size gearset is limited by the fact that in various positions of the rotor two of the five pockets are connected with each other, rather than being connected with one of the ports.

SUMMARY OF THE INVENTION

The present invention provides a new and useful hydraulic device of the gerotor gear set type which is simple in construction, is easily manufactured, and utilizes the rotor to efficiently valve fluid from the ports to and from the fluid pockets.

The gerotor gear set of the present invention includes a stator and a rotor which rotates and orbits relative to the stator. The gear set is disposed between a pair of housing members. One end face of the gear set and the face of the adjacent housing member cooperate to form a manifold side of the device and the other end face of the gear set and the face of the adjacent housing member cooperate to form a valve side of the device.

At the manifold side of the device, the end face of the rotor and the face of the adjacent housing member cooperate to define separate high and low pressure areas which are continuously communicated with high and low pressures, respectively. At the valve side of the device, the rotor has a circular array of openings which number twice the number of teeth of the rotor. A series of passages extending through the rotor communicate all of the openings of the circular array with the separate pressure areas at the manifold side of the device, alternate openings being communicated with areas at different pressures. As the rotor rotates and orbits, the alternate openings of the circular array are continuously communicated with the respective high and low pressures.

At the valve side of the device, the face of the housing member adjacent the rotor has radially extending recesses facing the pockets defined by the teeth of the stator and rotor. As the rotor rotates and orbits, the circular array of openings move relative to the recesses in the end face of the adjacent housing member. In certain positions of the rotor, an opening may be in facing relation with a particular recess, thereby opening communication and establishing a flow passage between a fluid pocket and one of the pressure areas. In other positions of the rotor, the face of the adjacent housing member block (close) communication between the opening and the recesses. As the rotor rotates and orbits, valving occurs as the adjacent end faces of the rotor and housing member cooperate to open and close communication between the openings in the rotor and the recesses in the adjacent housing member in timed relation to the movement of the rotor.

The valve structure of the invention has several advantages over the prior art. It avoids the use of a separate valve member manifold plate or valve plate as found in many prior art patents. Thus, it is a simple structure with a minimum number of interfaces which need to be sealed against leakage. The structure also avoids the need for the type of "dog leg" shaped passages found in the housing of U.S. Pat. No. 211,769 and in the valve member of German OS No. 2,921,311, which are complex passages to manufacture.

Further, the valve structure of the invention is efficient. It is designed such that as the rotor rotates and orbits there is substantially continuous direct communication (i) between the high and low pressures and (ii) all of the fluid pockets except a "null" pocket (i.e., a pocket which is switching from communication with one pressure to communication with the other pressure). Thus, unlike the device of U.S. Pat. No. 3,825,376, there is no need to provide a "short circuit" between adjacent pockets. The "short circuit" diminishes the effective displacement of the device, whether it be a pump or motor.

BRIEF DESCRIPTION OF THE DRAWINGS

Further features and advantages of the present invention will become apparent from the following detailed description of the present invention made with reference to the accompanying drawings wherein.

DETAILED DESCRIPTION OF THE PREFERRED EMBODIMENTS

As noted above, the invention relates to a device with expansible and contractible pockets formed by a gerotor gear set, and particularly to a new and useful system for directing fluid to and from the fluid pockets of the gear set. The following specification relates to a hydraulic motor constructed according to the principles of the invention. However, from the description it will be clear that the principles of the invention can be used in the construction of other types of hydraulic devices such as pumps.

Figure 1:
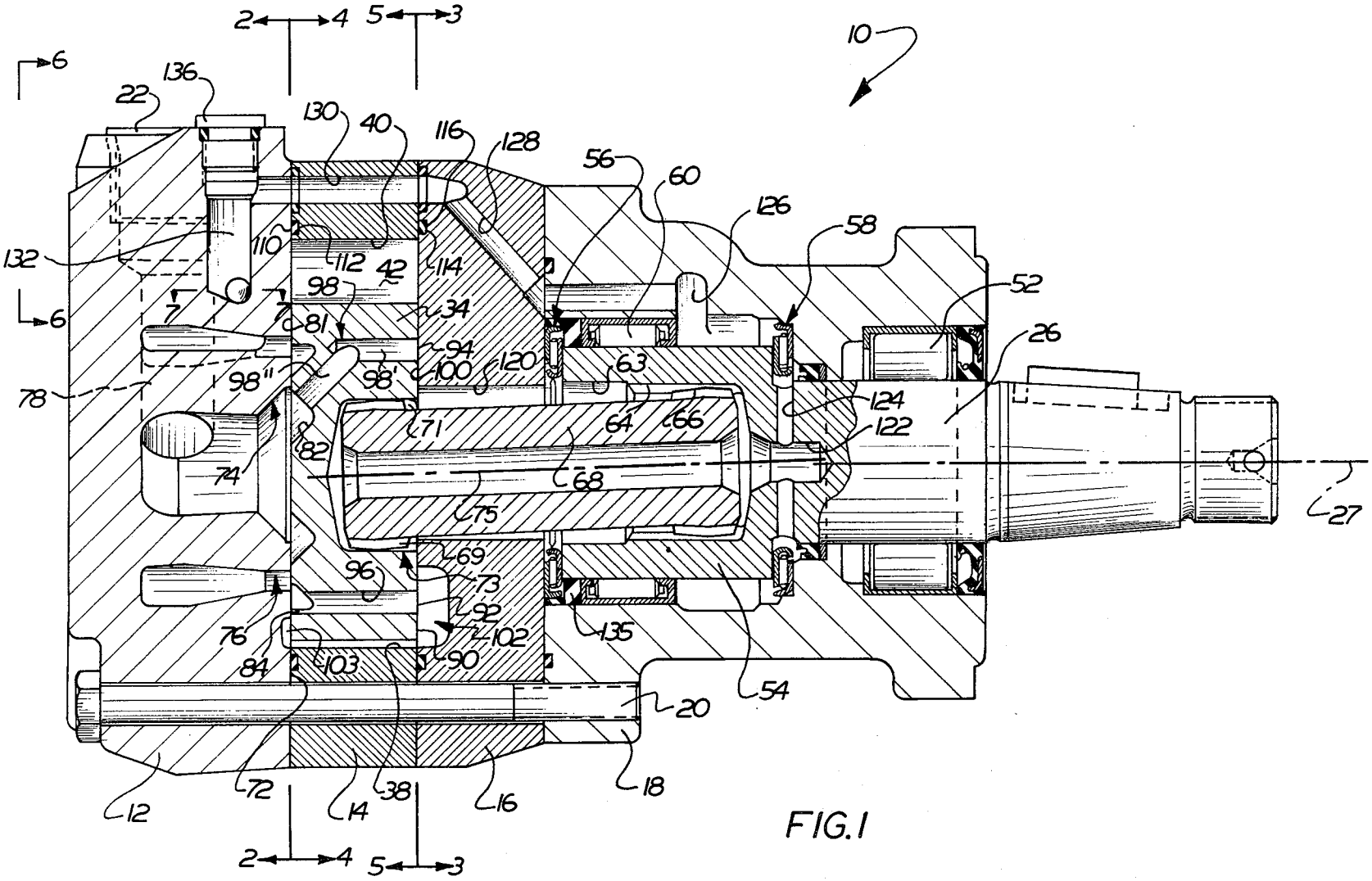
FIG. 1 is a longitudinal sectional view of a hydraulic device embodying the present invention.
Figure 6:
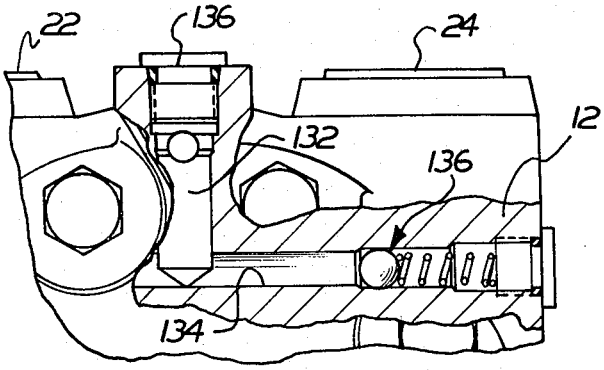
FIG. 6 is an end view of a portion of the device, taken from the direction 6—6 in FIG. 1, and showing some portions in section.

FIG. 1 shows a hydraulic motor 10. The motor 10 includes an outer housing formed by a series of housing members 12, 14, 16 and 18 fixed together by a series of bolts 20. The housing member 12 constitutes an end cover and includes an inlet port 22 and an outlet port 24 (see FIGS. 1 and 6). The opposite housing member 18 rotatably supports an output shaft 26 for rotation about a central axis 27. The output shaft 26 is rotatably driven by a gerotor gear set in a manner described hereinafter.

Figure 5:
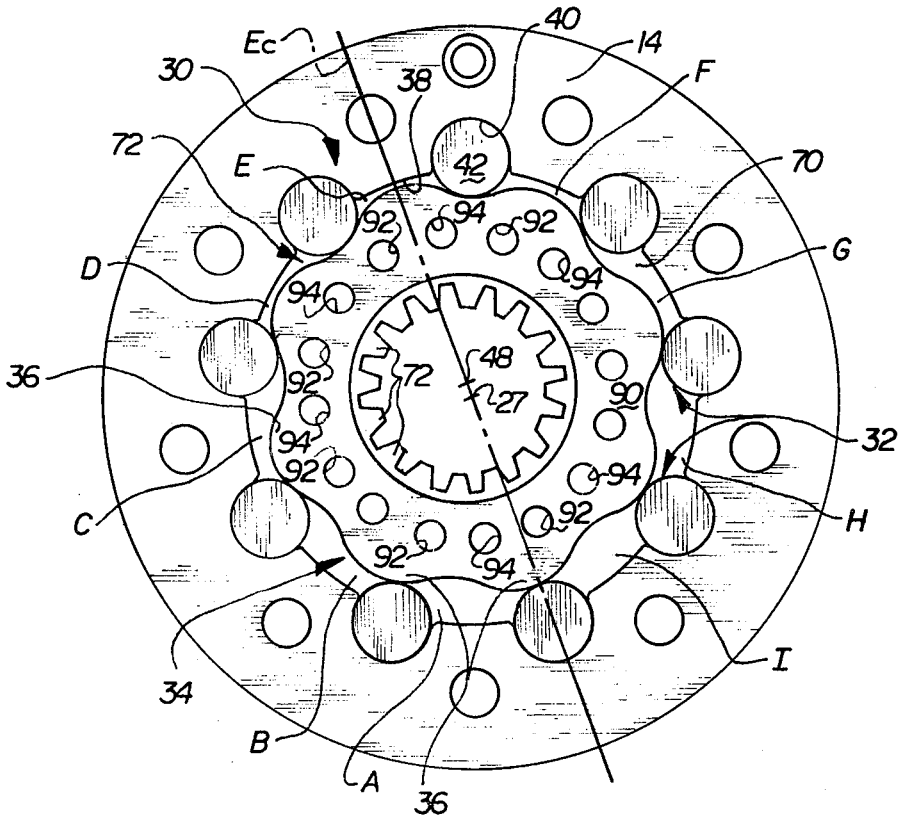

The gerotor gear set is formed between the housing members 12 and 16. Basically, the gerotor gear set comprises a stator 30 with N internal teeth 32, and a rotor 34 with N-1 external teeth 36 (see FIG. 5). The housing member 14 forms an annular stator plate that is part of the internally toothed stator 30. Referring to FIGS. 1 and 5, the stator plate 14 has an internal circumferential surface 38 defining a series of cylindrical recesses 40 which support cylindrical roller vane elements 42. The roller vane elements 42 can rotate in their respective recesses 40 and shift both radially and circumferentially in accordance with the principles of U.S. Pat. No. 3,289,602. The stator has a central axis which is coincident with the central axis 27 of the output shaft 26. The externally toothed rotor 34 is shown in FIGS. 1 and 5. The rotor 34 includes one less tooth than the stator 30, and has a central axis 48 which is eccentrically disposed relative to the central axis 27 of the stator. The rotor can rotate in one direction about its central axis 48 and can orbit in the opposite direction about the central axis 27 of the stator.

Referring back to FIG. 1, the output shaft 26 is journaled for rotation in the housing member 18 by means of cylindrical roller bearing elements 52. An enlarged section 54 of the output shaft 26 is disposed within the housing member 18, and is supported between axial thrust bearings 56, 58. Roller bearing elements 60 rotatably journal the enlarged section 54 in a bore in the housing member 18. The enlarged section 54 has a central opening 63 and internal splines 64 which engage a series of external splines 66 at one end of a wobble shaft 68. The other end of the wobble shaft 68 has external splines 69 which engage internal splines 71 formed in an opening 73 extending part-way into the rotor 34. The splined connections between the wobble shaft 68, the rotor 34 and the enlarged section 54 of the output shaft transmit rotary motion of the rotor to the output shaft 26. The wobble shaft 68 has a central axis 75 disposed at an angle to the central axis 27 of the output shaft 26. The splined connections between the wobble shaft 68, the enlarged section 54 of the output shaft and the rotor 34 are crowned in an axial direction so that the ends of the wobble shaft 68 can rock as it follows the orbital motion of the rotor.

Figure 9:
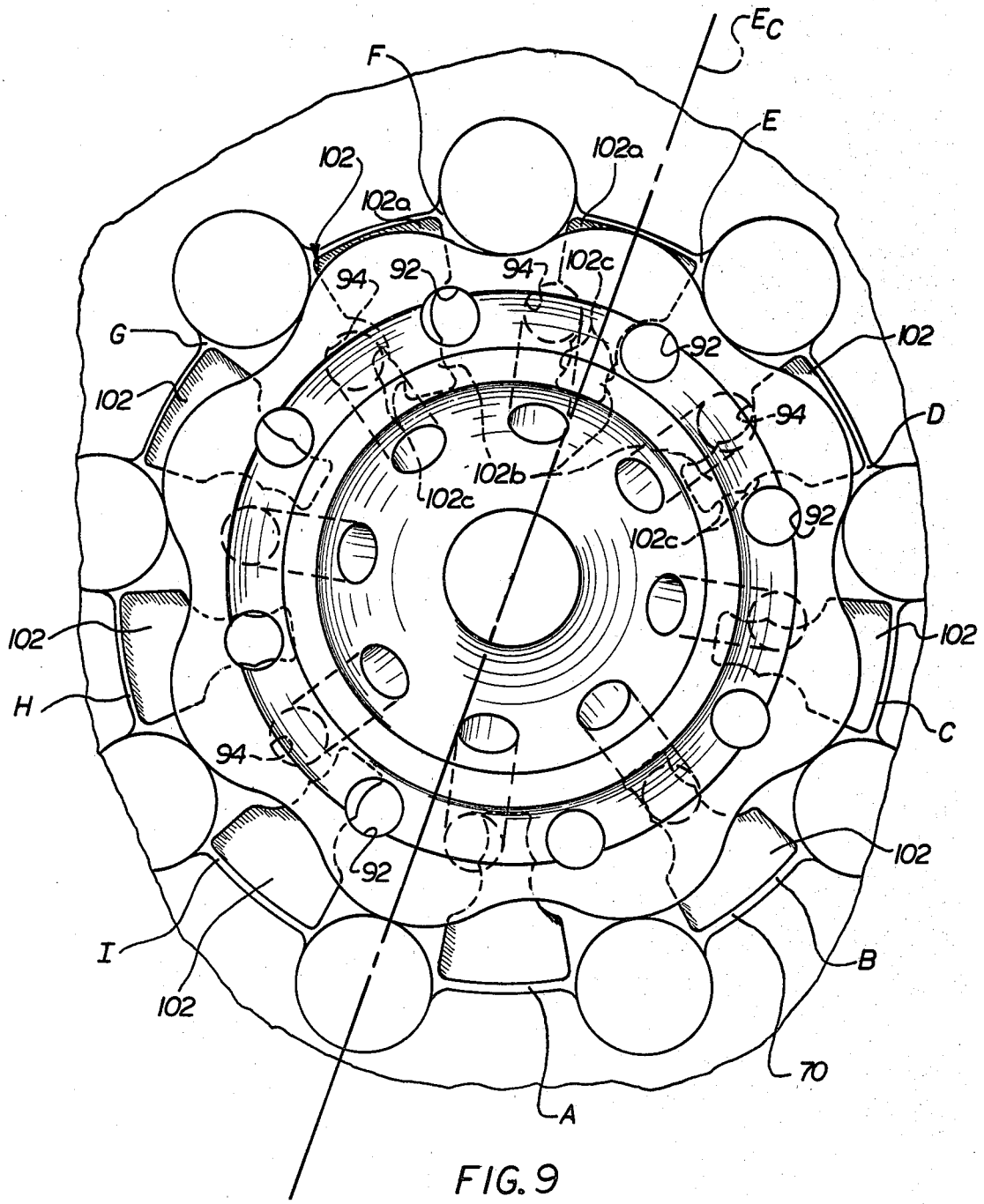
FIG. 9 is an enlarged schematic representation of the gear set and housing, viewed from the direction 4—4 in FIG. 1, and illustrating the valving at the valve side of the device.

The teeth of the rotor and stator define a series of fluid pockets 70 (FIGS. 5 and 9) which are expanded and contracted by the rotational and orbital motion of the rotor 34. As the rotor rotates and orbits, the fluid pockets on one side of a line of eccentricity Ec extending through the central axis 27, 48 of the rotor and stator are expanded, and the fluid pockets on the other side of the line of eccentricity are contracted. For example, in FIG. 5, the fluid pockets are identified by the letters A-I. The pockets A-D are on one side of the line of eccentricity Ec. The pockets F-I are on the other side of the line of eccentricity. In the position shown in FIGS. 5 and 9, one set of pockets (i.e., A-D or F-I) would be expanding and the other set of pockets would be contracting.

In accordance with the principles of U.S. Pat. No. 3,289,602, as the rotor rotates and orbits the cylindrical roller vane elements 42 can shift circumferentially and radially to seal the expanding pockets from the contracting pockets. Also, as the rotor 34 rotates and orbits there is a fluid pocket which is switching from communication with one port (e.g. the high pressure port) to communication with the other port (e.g., the low pressure port). The applicant refers to it as the "null" pocket. In the position of the gears in FIGS. 5 and 9, the pocket E is at a minimum volume because a tooth on the rotor is at a maximum insertion into that pocket. The pocket E is switching from one pressure to the other pressure, and is referred to as a minimum "null" pocket. Similarly, in other positions of the rotor, a "null" pocket may be at a maximum volume while it is switching from one pressure to the other. For example, in FIG. 9 if the rotor position was rotated slightly clockwise, the pocket A would be at a maximum volume. The pocket would be switching from one pressure to the other, and would be referred to as a maximum "null" pocket. During the movement of the rotor the "null" pockets are formed sequentially, but never more than one "null" pocket or a pair of "null" pockets (maximum and minimum "null") are formed simultaneously.

As noted above, the present invention relates to a new and useful structure for valving fluid in timed relation to the movement of the gerotor gears. In the motor 10, the gear set is disposed between the end cover 12 and the housing member 16. The interfacing surfaces of the gear set and the end cover 12 form what may be termed a manifold side of the motor, and the interfacing surfaces of the gear set and housing member 16 form what may be termed a valve side of the motor.

Figure 2:
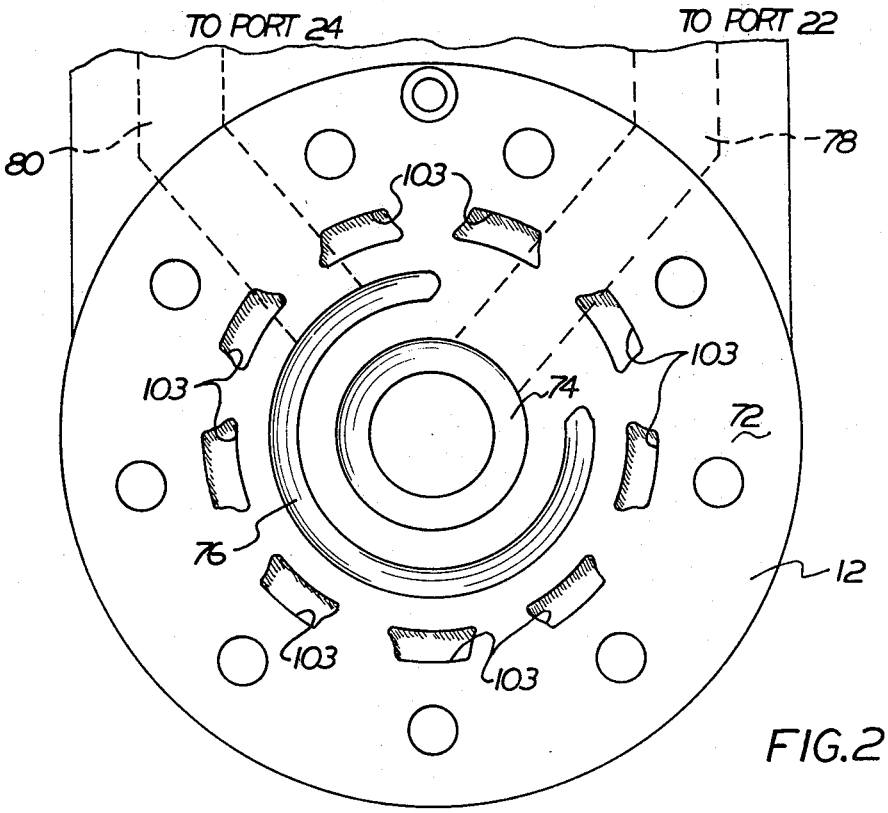
FIGS. 2 and 3 are views of the faces of the housing members adjacent the opposite sides of the gear set of the device of FIG. 1, taken from the directions 2—2 and 3—13 respectively in FIG. 1, with portions omitted.

The end face 72 of the end cover 12, at the manifold side of the motor, is shown in FIG. 2. It includes a pair of concentric pressure areas. An inner pressure area includes a circular recess 74 in the end face 72. An outer pressure area includes an arcuate recess 76 in the end face 72. A passage 78 in the end cover 12 (see FIGS. 1 and 2) communicates the inner circular recess 74 with the inlet port 22. A passage 80 communicates the arcuate outer recess 76 with the outlet port 24. Thus, the recesses 74, 76 forming the pressure areas are continuously communicated with the pressures at ports 22, 24, respectively.

Figure 4:
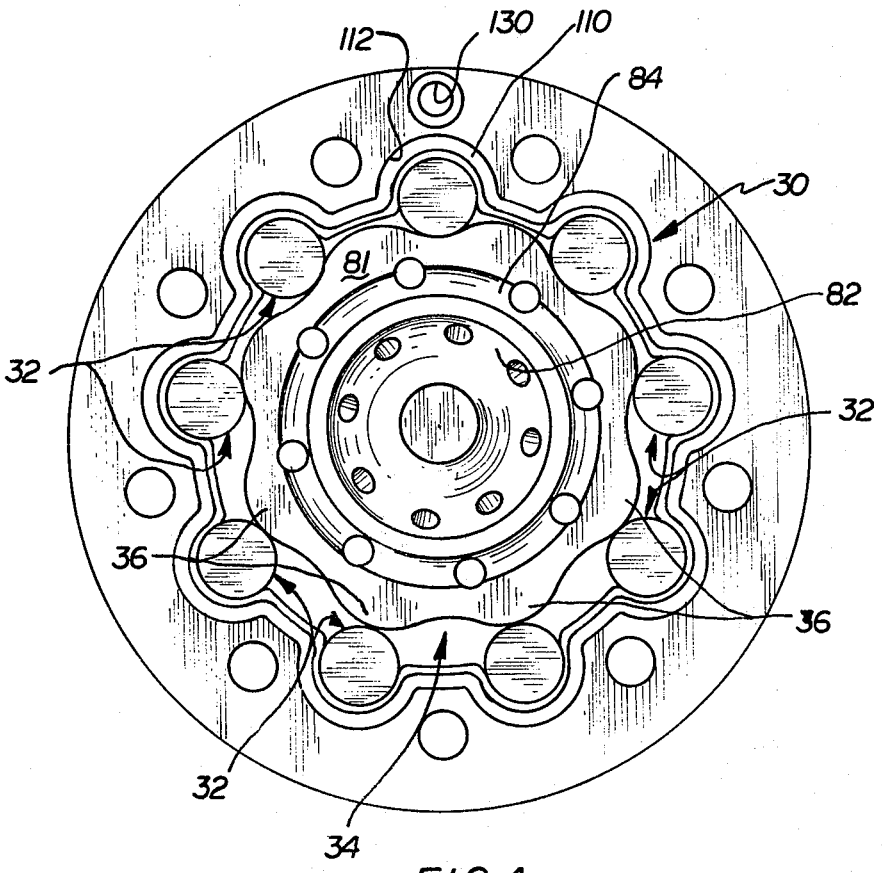
FIGS. 4 and 5 are views of the opposite axial end faces of the gear set of the device of FIG. 1, taken respectively along the lines 4—4 and 5—5 in FIG. 1, with some portions omitted, and with the position of the inner gear (rotor) shifted somewhat.
Figure 8:
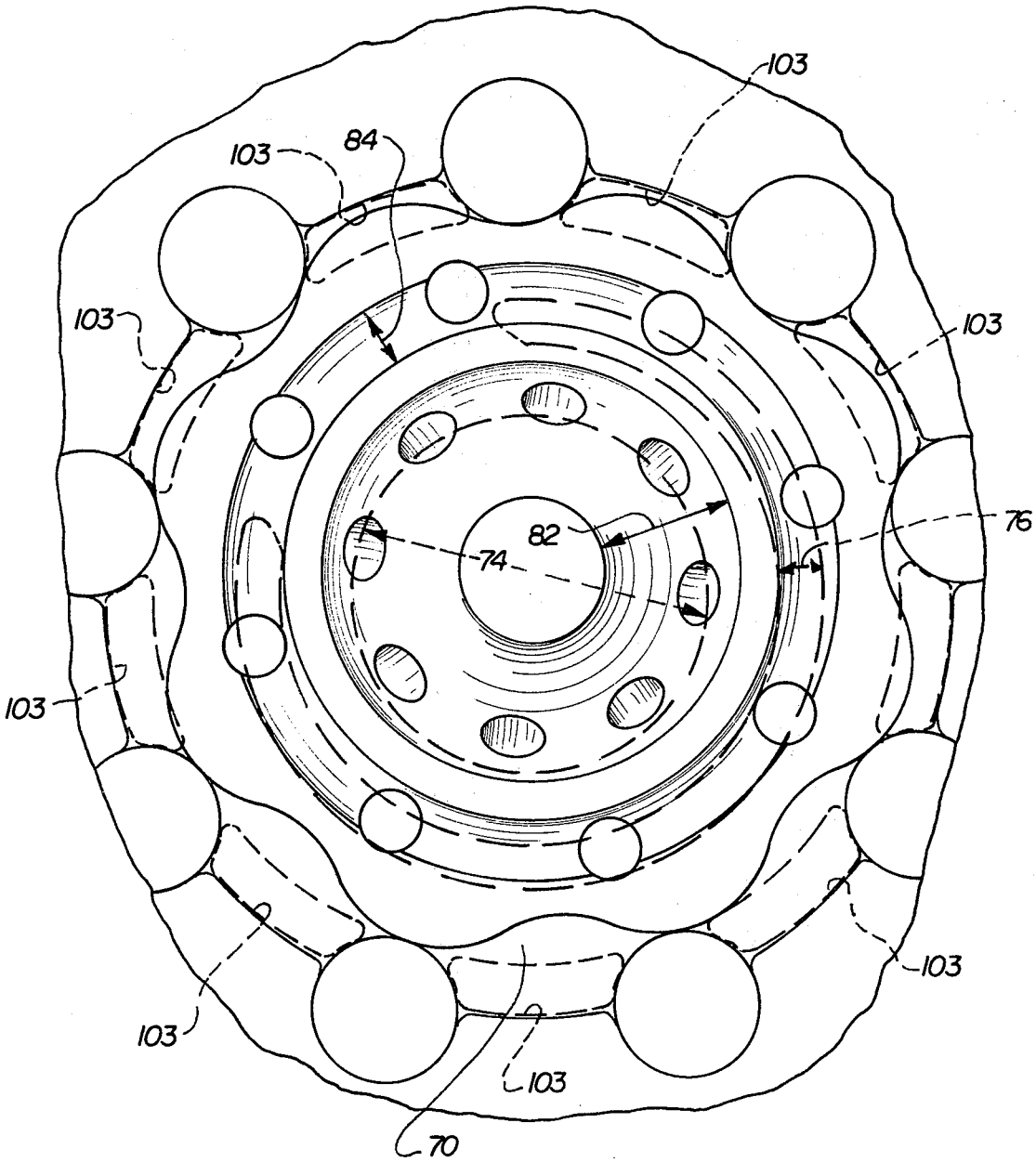
FIG. 8 is an enlarged schematic representation of the end face of the gear set at the manifold side of the device of FIG. 1 viewed from the direction 4—4 in FIG. 1, with parts of the adjacent housing face superimposed thereon.

The end face 81 of the rotor 34 at the manifold side is shown in FIG. 4. It includes an inner circular recess 82 and a concentric outer circular recess 84. As the rotor 34 rotates and orbits, what occurs at the manifold side of the motor can be seen from FIG. 8. The inner recess 82 in the rotor maintains continuous communication with the inner recess 74 in the end cover 12. The outer recess 84 in the rotor maintains continuous communication with the arcuate outer recess 76 in the end cover 12. Since the recesses 74, 76 in the end cover 12 maintain continuous communication with the ports 22, 24, respectively, the recesses 82, 84 in the end face 81 of the rotor are continuously communicated with the pressures at ports 22, 24, respectively, as the rotor rotates and orbits. Further, the end face 81 and the adjacent end face 72 of the end cover 12 cooperate to maintain the pressure areas hydraulically separate (i.e., they minimize leakage between the pressure areas) as the rotor rotates and orbits.

The opposite end face 90 of the rotor 34, at the valve side of the motor, has a circular array of openings. In FIG. 5, the openings are circular in configuration, and alternate openings are identified by the numbers 92 and 94. Each opening 92 has an adjacent opening 94 located on an opposite side of a rotor tooth 36 to constitute a pair of openings for valving purposes. As seen from FIG. 5, the total number of openings 92, 94 in the circular array at the valve side of the rotor 34 is twice the number of teeth 36 in the rotor.

A series of passages 96, 98 (FIG. 1) extend through the rotor 34 from the end face 90 at the valve side to the other end face 81 at the manifold side. Certain passages 96 extend axially through the rotor 34 and communicate the openings 92 in the valve side with the outer pressure recess 84 in the manifold side. Other passages 98, having axial portions 98' and angular, radially inwardly directed portions 98'' communicate the other openings 94 in the valve side of the rotor with the inner recess 82 in the manifold side. As a result of this construction, the openings 92 are continuously communicated with the port 24 and the alternate openings 94 are continuously communicated with the port 22.

Figure 3:
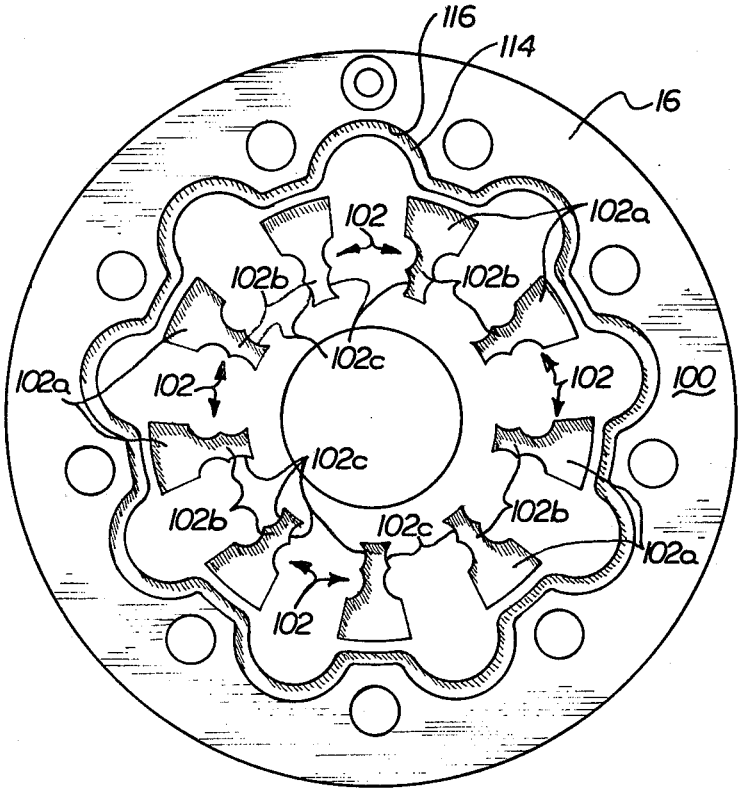

The face 100 of the housing member 16 at the valve side of the motor has a series of generally T-shaped recesses 102 (see FIG. 3). Each T-shaped recess 102 has a cross portion **102*a* facing a respective pocket 70 between adjacent teeth 32 in the stator 30. A stem portion 102*b* extends radially inward from the cross portion, and preferably includes several concave valving edges shown at 102*c***.

The recesses 102 communicate directly with the fluid pockets. As the rotor 34 rotates and orbits, the circular array of openings 92, 94 in the rotor move relative to the T-shaped recesses 102. In certain positions of the rotor, an opening 92 or 94 may be underlapped with the valving edge **102*c* of a recess, and thus in facing relation with the stem portion 102*b* of the recess. A flow passage is thereby established between the fluid pocket communicating with that recess and one of the pressure areas. In other positions of the rotor, the opening may be overlapped with respect to the recesses, and thus blocked (closed) from communication with the recesses. As shown in the schematic example of FIG. 9, each opening 92 on one side of the line of eccentricity, Ec, is in facing relation with the stem portion 102*b* of a recess on the same side of the line of eccentricity. Thus, flow passages are established between fluid pockets F, G, H, I and port 24. Each opening 94 on the other side of the line of eccentricity, Ec, is in facing relation with the stem portion 102*b* of a recess 102 on that side of the line of eccentricity. Thus, flow passages are established between the fluid pockets A, B, C, D and the port 22**.

The pair of openings 92, 94 associated with the "null" pocket, (i.e., associated with the minimum "null" pocket E in FIG. 9), are overlapped with respect to the edges 102*c* of the recess 102 communicated with that pocket. Thus, both ports are blocked from communication with that pocket. As the rotor rotates and orbits, valving occurs as the adjacent end faces 90, 100 of the rotor and housing cooperate to open and close communication between the openings 92, 94 and the recesses 102 in timed relation to the movement of the rotor.

The end cover face 12 at the manifold side of the motor 10 includes a series of pressure balance recesses 103 equal in number to the number of teeth 32 of the stator 30. Each pressure balance recess 103 faces a respective pocket 70 between the adjacent teeth 32 of the stator 30 which define that pocket (see FIG. 8). Further, as seen from FIG. 8, the pressure balance recesses 103 have sufficient radial extent so as to face portions of the rotor 34 as it rotates and orbits. The pressures in the fluid pockets 70 are communicated to the associated pressure balance recesses 103. As the rotor rotates and orbits, those pressures exert axial forces on appropriate portions of the rotor 34 to provide pressure balance to the rotor.

The foregoing valve structure ensures that as the rotor rotates and orbits, each port 22, 24 has direct communication with each of the pockets 70 on one side of the line of eccentricity. The port 22 has direct communication with pockets on one side of the line of eccentricity through the passages 98 in the rotor, and the flow passages formed between the openings 94 and the recesses 102 which are in facing relation. The port 24 has direct communication with the pockets on the other side of the line of eccentricity through the passages 96 in the rotor, and the flow passages formed between the openings 92 and the recesses 102 which are in facing relation. The openings 92, 94 associated with the "null" pocket are blocked by the housing end face 100, and thus block the "null" pocket from communication with the ports 22, 24. The valve structure is believed to provide consistent levels of communication between the ports and the fluid pockets. Further, by communicating the ports directly with each pocket on opposite sides of the line of eccentricity, it is believed to have the capacity to provide high volumetric flow between the ports and the pockets as the rotor rotates and orbits.

As can be seen from the foregoing description, in the motor constructed according to the invention, fluid flow is manifolded into the rotor 34 at the manifold side, and is valved and directed to and from the fluid pockets 70 solely at the interface of the rotor and the housing member 16 at the valve side. The facing surfaces of the rotor 34 and the housing members 12, 16 at the manifold side and the valve side, respectively, are the principal interfaces to be sealed against leakage of fluid. To effect sealing at the manifold side, a static seal ring 110 having a contour similar to that of the stator teeth is disposed in a correspondingly shaped groove 112 in the stator plate 14 radially outward of the pockets. At the valve side, a similarly contoured static seal ring 114 is disposed in a correspondingly shaped groove 116 in the housing member 16.

Figure 7:
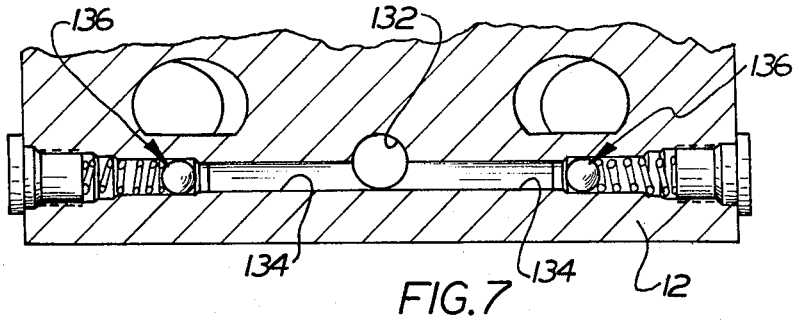
FIG. 7 is a sectional view taken along the line 7—7 of FIG. 1.

The motor 10 of FIG. 1 also includes structure for handling fluid which leaks inwardly at the valve side of the motor. A central opening 120 is provided in housing member 16. The central opening 120 communicates through the bore 63 and a pair of passages 122, 124 in the shaft portion 54 with a passage 126 in the housing member 18. Passage 126, in turn, communicates through passages 128, 130 in housing member 16 and stator plate 14, respectively, with a chamber 132 in end cover 12. Chamber 132 has a pair of outlet passages 134 (FIGS. 6, 7) communicating through check valves 136 and drilled passages (not shown) in the end cover 12 with the fluid passages 78, 80 connected with the ports 22, 24. With the foregoing construction, high pressure fluid leaking into the center of the gear set can be vented through the chamber 132 and the appropriate check valve to whichever port is at the lower pressure.

A low pressure seal 135 minimizes leakage flow past roller bearing elements 60. Thus, it helps insure that any leakage flow is through the spline teeth 64, 66 which is desirable because the leakage flow can reduce heat build-up in the spline teeth.

As seen in FIGS. 1 and 2, the motor includes a port 136 for draining the fluid therefrom.

The motor of FIGS. 1–7 is believed to be relatively simple to construct. End cover 12 and housing member 18 are preferably cast, and housing member 16 is readily adaptable to being stamped or cast. The passages 96, 98 extending through the rotor 34 are readily constructed by drilling and reaming.

Figure 10:
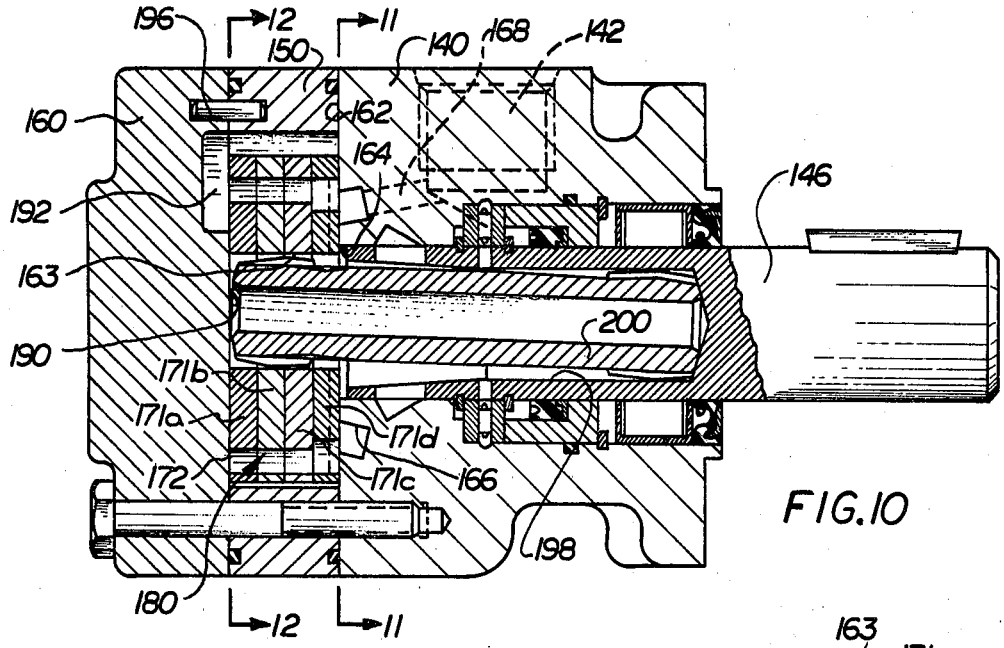
FIG. 10 is a longitudinal sectional view of a hydraulic device according to a modified form of the invention.

An alternate construction for a motor according to the principles of the invention is shown in FIGS. 10–13. As shown in FIG. 10, the motor comprises only three members forming its external housing. A housing member 140 includes an inlet port 142 and an outlet port 144. The housing member 140 also supports the various bearing and sealing elements for supporting an output shaft 146.

Figure 11:
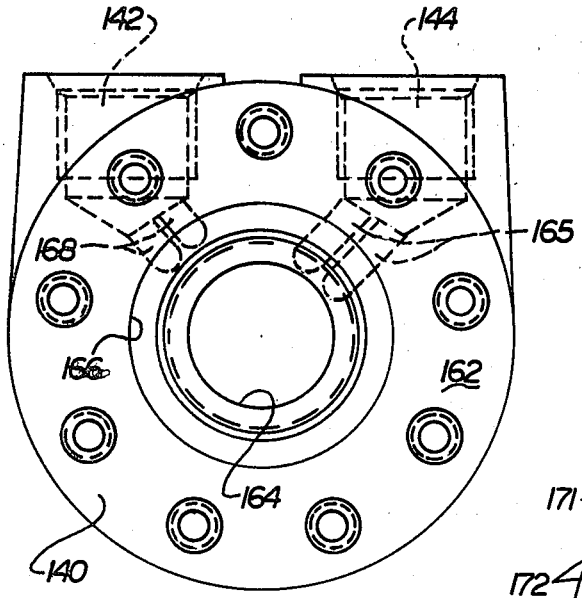
FIG. 11 is a view of the face of the housing adjacent the gear set at the manifold side, taken along the lines 11—11 of FIG. 10 with portions omitted.
Figure 13:
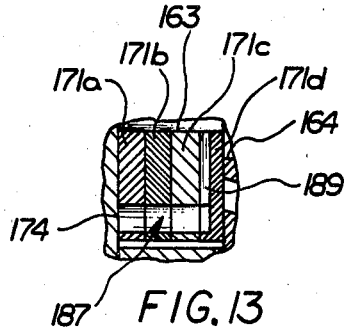
FIG. 13 is an enlarged, fragmentary, sectional view of a portion of the rotor of the device of FIG. 10.
Figure 12:
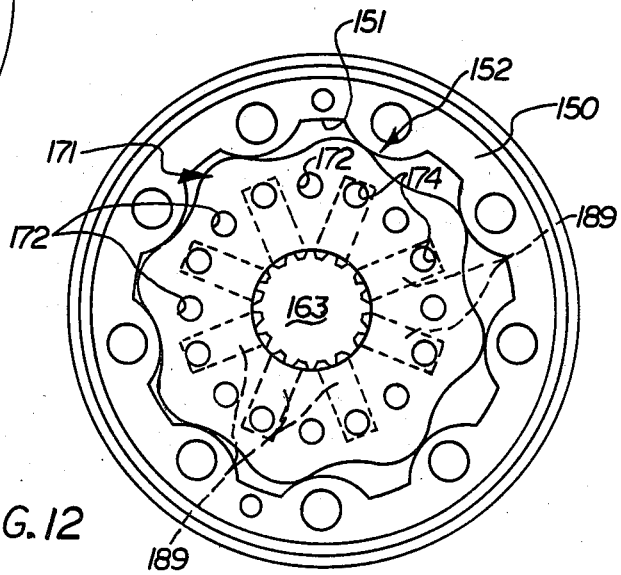
FIG. 12 is a view of the gear set of the device of FIG. 10 at the valve side, taken along the line 12—12 of FIG. 10 with portions omitted.

Another housing member is a stator plate 150. The stator plate has an internal surface 151 forming the internal teeth 152 of the stator. As seen from FIG. 12, the internal teeth 152 of the stator are of a fixed form, as opposed to the roller vane construction of the previous embodiment. Since the fixed form of stator tooth shown in the embodiment of FIGS. 10–12 is well known, its construction is not described further herein.

An end cover 160 completes the external housing of the motor of FIGS. 10–13. In the motor, the manifold side is formed between the gear set and the housing member 140, and the valve side is formed between the gear set and the end cover 160. At the manifold side, the end face 162 of the housing member 140 includes a central opening 164 communicating with a central opening 163 in the rotor, and also communicating through passages 165 with one port 144. The end face 162 of the housing member also includes an annular recess 166 surrounding the central opening and communicated through passages 168 with the other port 142.

The rotor 171 in the motor of FIGS. 10–13 is comprised of four plates 171*a*, 171*b*, 171*c* and 171*d*. The plates are of equal thickness, and are fixed together, preferably by copper brazing techniques. The plates form a circular array of openings 172, 174 at the valve side in a manner similar to that shown and described in the previous embodiment.

The plates 171*a*–171*d* have appropriate holes forming axial passages 180 extending axially through the rotor for communicating alternate holes 172 with the annular recess 166 in housing member 140 as the rotor 171 rotates and orbits. As seen from FIG. 13, the plates 171*a*, 171*b* and 171*c* have holes forming axial passages 187. Those passages 187 communicate with radially inwardly extending passages 189 in plate 171*d* which communicate with the central opening 163 in the rotor and thereby with the central opening 164 in the housing member 140. Thus, the passages 187 and 189 communicate the central opening 164 with the remaining alternate openings 174 in the valve side of the rotor 171, as the rotor rotates and orbits.

At the valve side of the rotor, the face 190 of the end cover 160 adjacent the rotor 171 includes a series of T-shaped openings 192 configured in a similar manner to those shown in the previous embodiment. The circular array of holes 172, 174 at the valve side of the rotor 171 cooperate with the T-shaped openings 192 to valve flow and direct flow to and from the pockets at the valve side in a manner similar to that of the previous embodiment.

The embodiment of FIGS. 10–13 may simplify construction of the motor beyond that of the previous embodiment. As can be clearly seen in FIG. 10, the external housing of the motor constitutes only three members (i.e., the housing member 140, the stator plate 150 and the end cover 160). The stator plate 150 and end cover 160 can be accurately aligned, to insure proper valving, by means of dowel pins 196 disposed in appropriate holes in the stator plate and the end cover.

Moreover, in the embodiment of FIGS. 10–13, the central openings 163, 164 in the rotor 171 and housing member 140, respectively, constitute the one pressure side of the motor, so that the motor does not require any separate structure for venting fluid leaked from the pockets.

Still further, in the embodiment of FIGS. 10–13, the output shaft 146 has a constant external diameter for its entire length. This simplifies its construction in comparison to the previous embodiment because it does not include sections of differing diemeters which need to be accurately centered during fabrication. Also, it has a fairly long central opening 198 receiving the wobble shaft 200. This allows the wobble shaft to be relatively long and a long wobble shaft enhances the mechanical efficiency of the motor.

As with the previous embodiment, the essential sealing at the interfaces of the members at the manifold side and valve side is simply accomplished by means of static seals in the stator plate 150.

Thus, according to the present invention there has been provided what is believed to be a new and useful commutation valve construction for a gerotor gear set device. It is believed that while the foregoing description relates to a motor construction with the principles of the invention, the manner in which the principles of the invention can be used to construct other forms of hydraulic devices (e.g., pumps) will become readily apparent to those of ordinary skill in the art.

What is claimed is:

1. A hydraulic device comprising:

(a) a gerotor gear set comprising (i) a stator with a number of internal teeth equal to N, (ii) a rotor with a number of external teeth equal to N−1, (iii) the teeth of the rotor and stator intermeshing and forming a number of expansible and contractible fluid pockets equal to N, (iv) the rotor having a central axis which is eccentric to the central axis of the stator, (v) the rotor rotating and orbiting relative to the stator to expand and contract the fluid pockets;

(b) first and second housing portions located adjacent opposite axial sides of said gerotor gear set, (c) one axial end face of said rotor and the adjacent face of said first housing portion cooperating to form separate pressure areas which are continuously communicated with high and low pressure, respectively, as the rotor rotates and orbits, characterized in that (i) the other axial end face of said rotor has a circular array of openings equal to twice the number of teeth on the rotor, (ii) passages formed in the rotor and extending through the rotor to continuously communicate adjacent openings with pressure areas at different pressures and alternate openings with pressure areas at the same pressure, (iii) the face of the second housing portion adjacent the other axial end face of the rotor has a number of recesses therein equal to N, (iv) each of said recesses facing and opening into a respective fluid pocket and extending radially therefrom, said recesses cooperating with portions of the adjacent end face of said rotor to form fluid passages for directing fluid to and from the pockets and (v) said recesses also having portions which cooperate with said circular array of openings in said other axial end face of the rotor to valve flow as the rotor rotates and orbits, the valved flow being directed to and from the pockets by said fluid passages.

2. A hydraulic device as defined in claim 1 characterized in that the fluid passages defined by the other axial end face of the rotor and said recesses in the adjacent face of the second housing portion direct flow to and from the fluid pockets solely along the interface of the other axial end face of the rotor and the second housing member as the rotor rotates and orbits.

3. A hydraulic device as defined in claim 2 wherein the separate pressure areas between the one axial end face of the rotor and the adjacent face of the first housing portion comprise inner and outer annular pressure areas concentric with the central axis of the rotor, characterized further in that the passages formed in said rotor and extending through said rotor comprise first passages extending axially through the rotor and communicating one half the openings in the other axial end face of the rotor with the outer annular pressure area and second passages having axially extending portions and radially inwardly extending portions communicating the other half of the openings in the other axial end face of the rotor with the inner annular pressure area, the openings of the one half alternating in the circular array with the openings of the other half.

4. A hydraulic device as defined in any of claims 1, 2 or 3 further characterized in that each recess in the second housing portion has a generally T-shaped configuration including a cross piece shaped portion facing a respective pocket between adjacent teeth of the stator, and a stem shaped portion extending radially inward therefrom, the circular array of openings in the rotor cooperating with the stem shaped portions of the radial recesses to valve fluid.

5. A hydraulic device as defined in claim 4, further characterized in that the stem portions of the T-shaped recesses have concave valving edges, the openings in the other axial end face of the rotor having generally circular configurations.

6. A hydraulic device as defined in claim 4 wherein the teeth of the stator are formed on a stator plate member disposed between and fixed to the first and second housing portions, the pair of ports being formed in the first housing portion adjacent the one axial end face of the rotor where the pressure areas are formed.

7. A hydraulic device as defined in claim 4 further characterized in that the face of the first housing portion adjacent the one axial end face of the rotor includes N pressure balance recesses, each facing a respective pocket, the fluid pressures in the pockets being communicated to the pressure balance recesses.

8. A hydraulic device as defined in claim 4 further characterized in that the radially inwardly extending portions of the second passages in the rotor are disposed at an acute angle to the central axis of the rotor.

9. A hydraulic device as defined in claim 4, wherein one of said separate pressure areas communicates with a central opening in the rotor, further characterized in that the rotor is formed by a plurality of plates which are fixed together, the radially inwardly extending portions of the second passages in the rotor being formed in at least one of said plates and communicating with the central opening in the rotor.

10. A hydraulic device comprising:

(a) a gerotor gear set comprising
  (i) a stator with a number of internal teeth equal to N,
  (ii) a rotor with a number of external teeth equal to N−1,
  (iii) the teeth of the rotor and stator intermeshing and forming a number of expansible and contractible fluid pockets equal to N,
  (iv) the rotor having a central axis which is eccentric to the central axis of the stator,
  (v) the rotor rotating and orbiting relative to the stator to expand and contract, respectively, the fluid pockets on opposite sides of a line of eccentricity;
(b) first and second housing portions located adjacent opposite axial sides of said gerotor gear set,
(c) one axial end face of said rotor and the adjacent face of said first housing portion cooperating to form separate pressure areas which are continuously communicated with high and low pressure, respectively, as the rotor rotates and orbits,
(d) commutation valve means for communicating one of said pressures at all times with each of the fluid pockets on one side of the line of eccentricity and communicating the other of said pressures at all times with each of the fluid pockets on the other side of the line of eccentricity and blocking communication of one of said fluid pockets with both pressures, characterized in that said commutation valve means comprises:

(i) a circular array of openings in the other axial end face of said rotor equal in number to twice the number of teeth on the rotor,
(ii) passages formed in the rotor and extending through the rotor to continuously communicate alternate ones of said openings with said respective pressure areas,
(iii) a face of the second housing portion adjacent the other axial axial end face of the rotor has a number of recesses therein equal to N,
(iv) each of said recesses facing and opening into a respective fluid pocket and extending radially therefrom, said recesses having portions which cooperate with portions of the said other axial end face of said rotor to define fluid passages for directing fluid to and from the fluid pockets as the rotor rotates and orbits, and
(v) said circular array of openings in the other axial end face of the rotor being spaced circumferentially relative to the circumferential spacing of said recesses in the adjacent face of the second housing portion and cooperating with portions of said recesses to valve flow to and from the pockets through said fluid passges and to block communication of said one of said fluid pockets with both pressures as the rotor rotates and orbits.

11. A hydraulic device as defined in claim 10 characterized in that the fluid passages defined by said other axial end face of the rotor and the recesses in the adjacent face of the second housing portion direct flow to and from the fluid pockets solely along the interface of said other axial end face of the rotor and the second housing member as the rotor rotates and orbits.

12. A hydraulic device as defined in claim 10 wherein the separate pressure areas between the one axial end face of the rotor and the adjacent face of the first housing portion comprise inner and outer annular pressure areas concentric with the central axis of the rotor, characterized further in that the passages formed in the rotor and extending through the rotor comprise first passages extending axially through the rotor and communicating one half the openings in the other axial end face of the rotor with the outer annular pressure area and second passages having axially extending portions and radially inwardly extending portions communicating the other half of the openings in the other axial end face of the rotor with the inner annular pressure area, the openings of the one half alternating in the circular array with the openings of the other half.

13. A hydraulic device as defined in any of claims 10, 11 or 12 further characterized in that each recess in the other housing member has a generally T-shaped configuration including a cross piece shaped portion facing a respective pocket between adjacent teeth of the stator and a stem shaped portion extending radially inward therefrom, the circular array of openings in the rotor cooperating with the stem shaped portions of the radial recesses to valve fluid by communicating each of the pockets on one side of the line of eccentricity through the fluid passages and with one pressure and communicating each of the pockets on the other side of the line of eccentricity through the fluid passages and with the other pressure as the rotor rotates and orbits.

14. A hydraulic device as defined in claim 13, further characterized in that the stem portions of the T-shaped recesses have concave valving edges, the openings in the other axial end face of the rotor having generally circular configurations.

* * * * *